US006343968B1

(12) United States Patent
Louie et al.

(10) Patent No.: US 6,343,968 B1
(45) Date of Patent: Feb. 5, 2002

(54) COMBINED SLEEPING BAG, CHARACTER DISPLAY ITEM, AND BACKPACK

(75) Inventors: Mei Ling Louie, East Northport, NY (US); Lee Michael Strongwater, Louisville, CO (US)

(73) Assignee: P & S Enterprises LLC, Niwot, CO (US)

( * ) Notice: Subject to any disclaimer, the term of this patent is extended or adjusted under 35 U.S.C. 154(b) by 0 days.

(21) Appl. No.: 09/493,985

(22) Filed: Jan. 28, 2000

(51) Int. Cl.[7] ..... A63H 3/02
(52) U.S. Cl. ..... 446/72; 2/69.5; 5/413
(58) Field of Search ..... 446/72, 73, 369, 446/327; 2/69.5, 69, 91, 66; 5/42 B, 44 B, 413, 417, 419, 414

(56) References Cited

U.S. PATENT DOCUMENTS

| | | | | | |
|---|---|---|---|---|---|
| 4,466,124 | A | | 8/1984 | Kirkham, Jr. | |
| 4,689,831 | A | * | 9/1987 | Greenberger et al. | 2/93 |
| 4,757,832 | A | * | 7/1988 | Russell | 2/69.5 X |
| 4,774,734 | A | | 10/1988 | Mills | |
| D300,681 | S | | 4/1989 | DeMars | |
| 4,856,131 | A | | 8/1989 | Mills | |
| 4,874,344 | A | | 10/1989 | Kanter | |
| D365,485 | S | | 12/1995 | Rossman | |
| 5,785,219 | A | * | 7/1998 | Kraft | 224/576 |
| 5,815,833 | A | | 10/1998 | Kuo | |
| 6,272,683 | B1 | * | 8/2001 | Symms et al. | 2/69.5 |

* cited by examiner

*Primary Examiner*—Kien T. Nguyen
(74) *Attorney, Agent, or Firm*—F. A. Sirr; E. C. Hancock; Holland & Hart LLP

(57) ABSTRACT

An elongated sleeping bag is proportioned to resemble a character when it is in an elongated, flat state on a relatively flat surface. An element resembling the head of a character is attached to the sleeping bag facing in the same direction as the front panel of the sleeping bag. The head element contains a pouch into which the sleeping bag can be stuffed so as to form a base or floor on which the head can stand for storage or display. Shoulder straps are attached to the head to permit carrying of the entire assembly as a backpack when the sleeping bag is stored within the pouch. Accessories can likewise be attached to the head. The combined sleeping bag, character display item, and backpack is primarily intended for use by children but could be fabricated for uses ranging from dolls to adults.

12 Claims, 4 Drawing Sheets

COMBINED SLEEPING BAG, CHARACTER DISPLAY ITEM, AND BACKPACK

BACKGROUND OF THE INVENTION

1. Field of the Invention

This invention relates to the field of sleeping bags that perform a bedding function particularly useful for a human child and which, when placed in a collapsed or stuffed state, can be displayed on a shelf or the like, and/or can be transported on the back of a person or child in the manner of a backpack.

2. Description of the Related Art

While sleeping bags, including those that resemble fictional characters, known animals, dolls, or other characters have been provided for use by children, and while backpacks for use by children are known, the need remains in the art for a combined sleeping bag and backpack wherein the appearance of the unfolded sleeping bag is entertaining to a child, and wherein the folded, stuffed, or collapsed sleeping bag forms a backpack that can be set on a shelf or the like for display in a manner to entertain the child, and wherein the folded, stuffed, or collapsed sleeping bag can be carried on the back of a child that is both pleasing and acceptable to child.

U.S. Design Pat. No. 300,681 provides a combination animal back rest and sleeping bag, and U.S. Design Pat. No. 365,485 provides a sleeping bag with pillow.

U.S. Pat. No. 4,466,124 provides a backpack and sleeping bag combination, and U.S. Pat. No. 5,815,833 provides a convertible article that provides sleeping bag, jacket and carrying bag utility.

U.S. Pat. No. 4,774,734 provides a sleeping bag that has an animated-object pouch, such as a cat-shaped pouch, that is located on an exterior surface of the sleeping bag. When the pouch is pulled inside out, the sleeping bag fills the pouch, and the animated object appears as a three-dimensional object. In an embodiment, the animated object is a knapsack having interior straps. When the knapsack is pulled inside out, the straps of the knapsack are for use by a child to carry the knapsack.

U.S. Pat. No. 4,856,131 provides a doll-shaped sleeping bag wherein the head of the doll forms a pillow.

U.S. Pat. No. 4,874,344 provides an animal toy having an openable abdominal cavity that holds baby-size animals, thus simulating a pregnant animal toy. A backpack container provides a bed or sleeping bag for the animal toy. When the animal toy is inserted into the backpack container, the animal toy's head protrudes from the backpack container.

SUMMARY OF THE INVENTION

The combination sleeping bag/backpack device of this invention is constructed and arranged to amuse, entertain, and be of general interest to a human child; for example, a child in the 2 to 8 year old range although the invention is not limited to use by those in that particular age group.

The characters that are represented by an unfolded state of the combination device of the invention (i.e., by the device's generally flat sleeping bag state) are that of a character that is lying in an extended state; for example, but without limitation to, an upward facing animal such as a bear, a leopard, a walrus, a gorilla, or a bull dog.

Compatible with sleeping bag use, the interior human body containing portion of the combination device is preferably made of a cloth such as flannel or a flannel-like material, and the exterior surface is preferably formed by a polar fleece material and/or a tricot material. While preferred embodiments of the invention are intended for sleeping bag use at relatively mild ambient temperatures, the spirit and scope of the invention is not to be limited thereto.

Pockets that are manually closable, such as by way of zippers, snaps, buttons, or Velcro-type hook and loop fabric fasteners are located outside of the device sleeping area, thus providing pockets for a child to store items of interest, these items being readily available to the child as the child occupies the sleeping bag portion of the device.

The sleeping bag portion of the device is permanently attached to a top-disposed, three-dimensional, and generally hollow head of the character, and this sleeping bag portion easily stuffs into a stuff pouch that is provided by the interior hollow cavity of the head, thus making it easy for the child to convert the device into a stuffed character head that can be placed on a surface for display. The rear portion of the character head (i.e., the back of the head portion) includes shoulder straps that facilitate carrying the stuffed character head in the manner of a backpack as the upright face of the character head faces to the rear of the child.

A toy-size sleeping companion or toy character and a small battery operated flashlight, such as a penlight or a squeeze light, may be further provided for the amusement of the child. For example, the toy character can releasably clip to the backpack, and a penlight can be releasably attached to the arm, leg, or paw of the toy character by the use of a Velcro hook/loop fastener.

The invention provides a combined child's sleeping bag, item of display and backpack that resembles a character well know to children; for example, an animal, a doll, or a cartoon character. A head portion of the character faces upward during sleeping bag use, and an interior portion of the sleeping bag immediately under the character head opens to form a pillow pouch into which a pillow can be removably inserted during sleeping bag use. During non-sleeping bag use, the base of the character head opens to form a nylon fabric lined stuff pouch into which the body of the character can be stuffed, this stuffing operation forming a relatively broad and flat base for the character head. This flat base can be used to support the stuffed character head in an upright position for display on a table and the like. The back of the head portion of the stuffed character head includes shoulder straps enabling a child to carry the stuffed character head on the child's back with the head being upright and facing backward of the child.

As a feature of the invention, the sleeping bag includes two character leg portions at the top of the sleeping bag and two character leg portions at the bottom of the sleeping bag, these leg portions being disposed so they do not interfere with movement of the body of a sleeping child, and at least the top-disposed leg portions being manually openable to facilitate the storage of items that are of interest to the child.

As an additional feature of the invention, a toy-size character is releasably attached, snapped, or clipped to the combined child's sleeping bag, item of display and backpack, this toy-size character being for the convenience and/or amusement of the child. For example, the child's sleeping bag may resemble an animal of a given species, and the toy-size character may resemble a small animal of the same species.

These and other features and advantages of the invention will be apparent to those of skill in the art upon reference to the following detailed description, which description makes reference to the drawing.

DESCRIPTION OF THE PREFERRED EMBODIMENT

Figure 1:
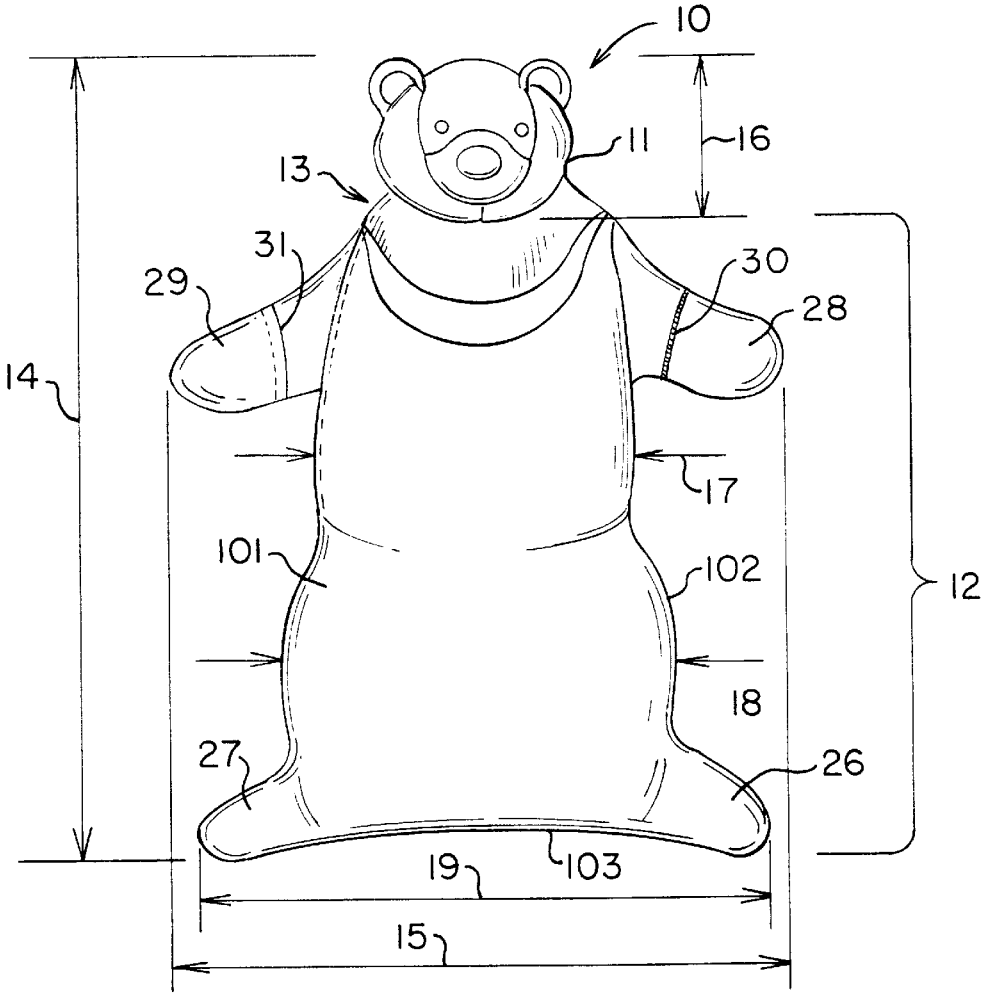
FIG. 1 is a top view of a combination sleeping bag and backpack in accordance with the invention, and which is particularly suitable for use by a child. In this figure, the top-disposed head and the lower contour resemble a Himalayan bear, and the combination device is spread out on a flat surface such as a floor or a conventional bed. This figure also shows a top-disposed opening that is openable by way of a left-side zipper to receive the body of a child, such that the head of the child can be located vertically over an internal pillow pouch (not shown) that is located below the bear head.

FIG. 1 is a top view of a combination sleeping bag, item of display, and backpack 10 that is constructed and arranged in accordance with the invention especially for use by a child. In FIG. 1, the top-disposed head 11 and the lower-disposed body contour 12 of device 10 resemble a Himalayan bear, and device 10 is spread out on a flat surface, such as a floor or a conventional bed, in order to provide for the sleeping bag use of device 10 by a child.

Figure 5:
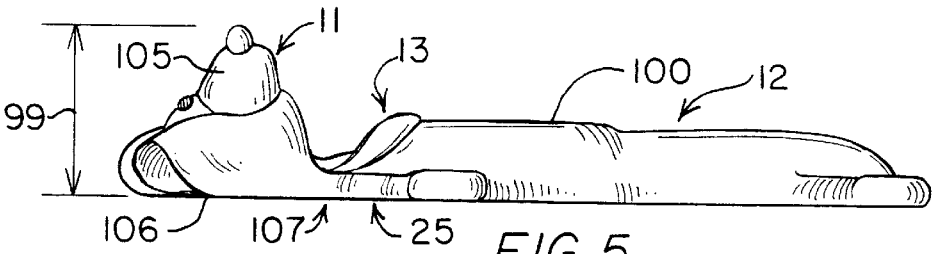
FIG. 5 is a side view of the combination sleeping bag and backpack of FIG. 1.
Figure 6:
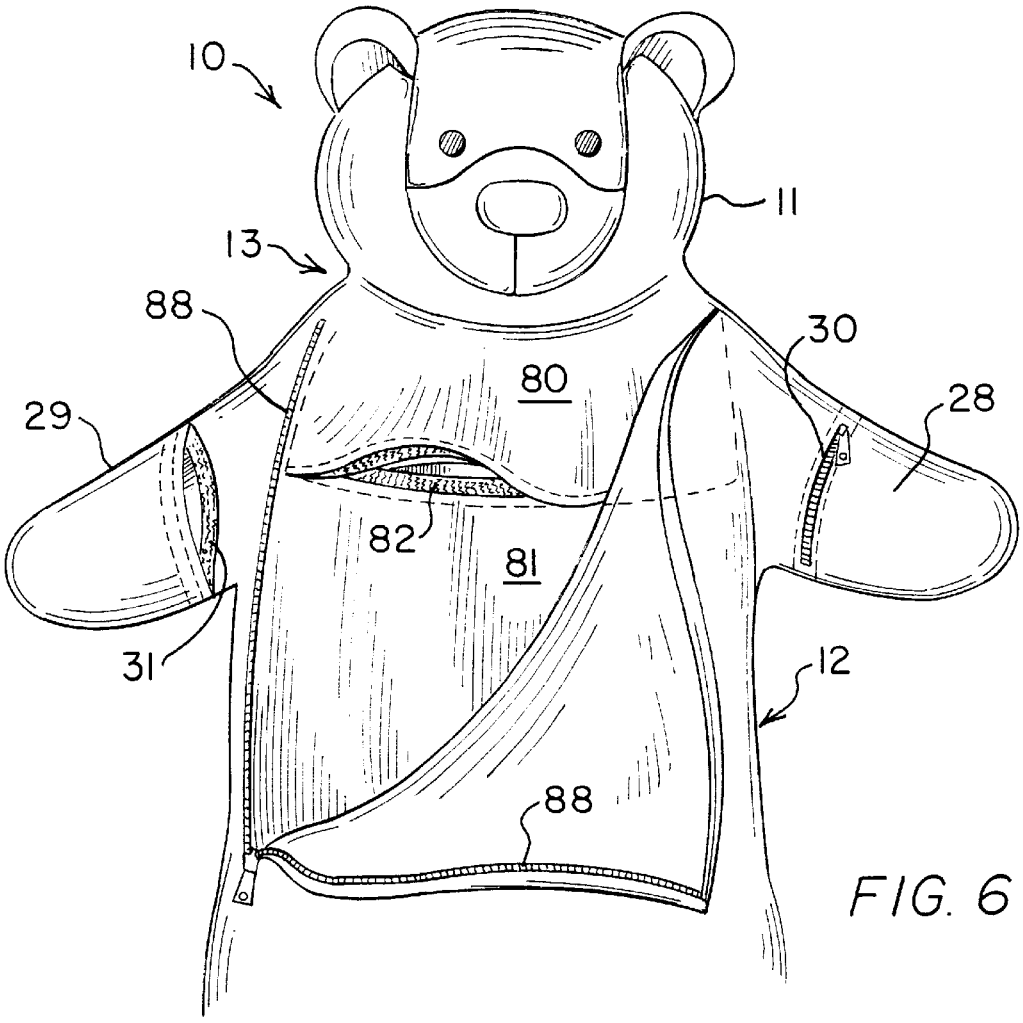
FIG. 6 is a partial top view of the FIG. 1 combination sleeping bag and backpack wherein the top panel of the sleeping bag is unzipped on the left side thereof so as to expose a pillow pouch disposed on the inner surface of the sleeping bag bottom panel, this pillow pouch providing for the placement of a pillow (not shown), and this unzipped position providing for ease of entry of the legs and then the torso of a child whose head will rest on the pillow.

FIGS. 1 and 6 also show a top-disposed opening 13 that is manually-openable by operation of a left-side zipper 88 to receive the body of a child. Thus, the head of the child can rest on a pillow inserted into a manually-openable pillow pouch 80 that is located on the interior surface 81 of a back or lower cloth panel 25 (see the FIG. 5 side view) of device 10. This pillow is then disposed at a location that is immediately below the bear head 11.

In use as a sleeping bag, a pillow is inserted into pillow pouch 80, whereupon pillow pouch 80 is closed, such as by the operation of a Velcro type closure member 82. The physical location of pillow pouch 80 and its internal pillow is such that the head of a child sleeping within the body portion 12 of device 10 is located on the pillow, as the three-dimensional head 11 of character 10 sits in an overlooking and protective fashion relative to the head of the sleeping child, this protective position of head 11 being best seen in FIG. 5.

As stated, character head 11 can be a three-dimensional hollow structure; for example, see FIG. 5. The type of construction that produces this three-dimensional structure is not critical to the invention. However, in a preferred embodiment, head 11 comprised multiple layers of a relatively thick fabric whose multiple pattern parts, when sewn together, form a three-dimensional, self-supporting, structure. It is within the spirit and scope of the invention to provide other head construction and arrangements; for example, to provide head 11 by using one, or more, molded plastic pieces.

Figure 2:
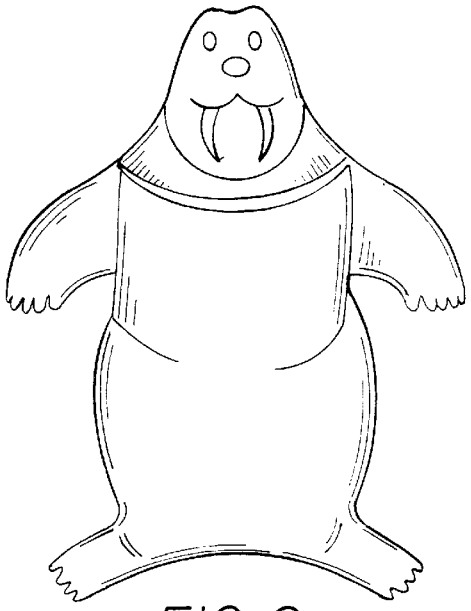
FIGS. 2, 3 and 4 are views similar to FIG. 1 that show other animal characters that can be incorporated into a combination sleeping bag and backpack in accordance with the invention, FIG. 2 providing the top-disposed head and lower body contour of a walrus, FIG. 3 providing the top-disposed head and lower body contour of a gorilla, and FIG. 4 providing the top-disposed head and lower body contour of a bull dog.
Figure 3:
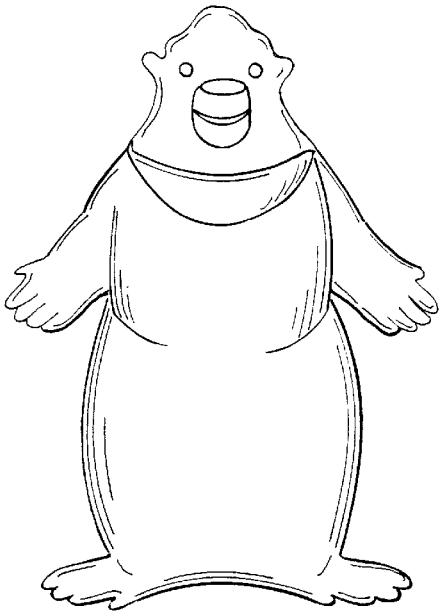
Figure 4:
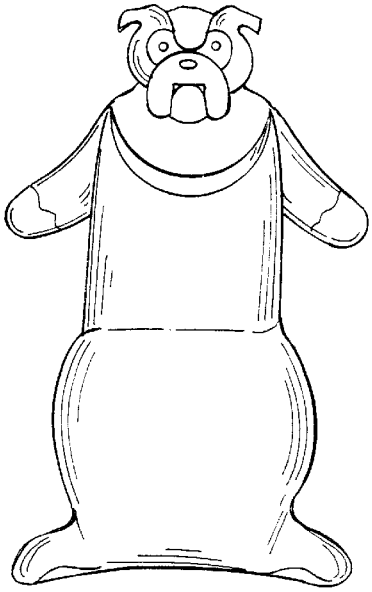

While the invention will be described while making reference to a character, such as a FIG. 1 bear, the spirit and scope of the present invention is not to be limited to this specific character, since other characters find utility in the invention of which the walrus of FIG. 2, the gorilla of FIG. 3 and the bull dog of FIG. 4 are non-limiting examples.

As used herein, the term "character" is intended to mean a three-dimensional physical object that is represented by device 10 when device 10 is in the extended, or sleeping bag state that is shown in FIGS. 1–4. In this state, the three-dimensional object 10 includes a three-dimensional and top-disposed head 11 and a lower-disposed and generally flat body portion 12. As such, the term "character" includes, but is not limited to, a broad range of animals, cartoon characters, dolls, fictional human characters, simulations of actual human characters, and the like, and especially those that are of general interest to children.

By way of example, only as taken from one model of the present invention pursuant to the FIG. 1 embodiment, the overall height 14 of the device 10 is about 67-inches, the height 16 of head 11 is about 12-inches, the front-to-back height 99 of head 11 (note FIG. 5) is about 16-inches, the overall width 15 of device 10 is about 50-inches, mid-section width 17 is about 26-inches, width 18 is about 31-inches, and width 19 is about 35-inches.

As shown, character 10 includes two rear-leg portions 26 and 27 whose interior portions may or may not be portions of a sleeping compartment that is provided by body portion 12. With reference to FIG. 6, the two front-leg portions 28 and 29 of character 10 preferably form two compartments that do not form portions of the sleeping compartment of body portion 12, although these compartments can be arranged as accessible from the interior of body portion 12.

Rather, leg portions 28 and 29 as shown are intended to provide pockets that a child may use to store objects of interest. By way of example, pocket 28 is closed by a zipper 30, and pocket 29 is closed by a fabric hook and loop fastener 31 of the Velcro type.

Figure 9:
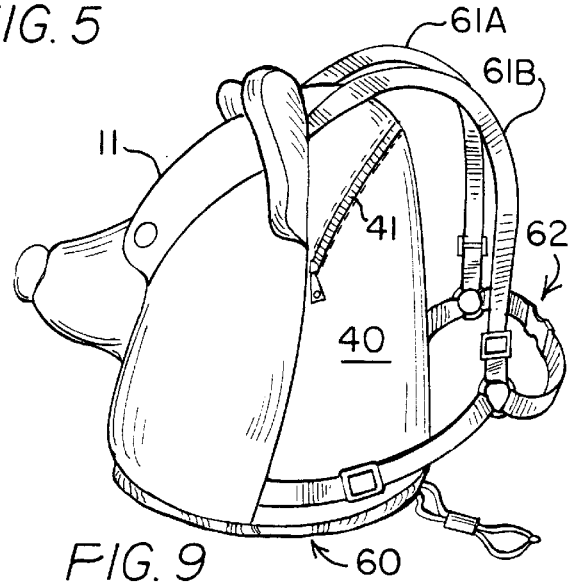
FIG. 9 is an upright view similar to FIG. 8, this figure showing how the stuffed head of the Himalayan bear character may be placed on a shelf, or the like, for storage and/or display, and this figure showing backpack straps that facilitate carrying the stuffed head of the Himalayan bear character on the back of a child, as shown in FIG. 10.

In addition, and as is shown in FIG. 9, the back surface 40 of character head 11 includes a zipper 41 that is openable to provide further pouch storage space for articles of interest to the child.

Figure 7:
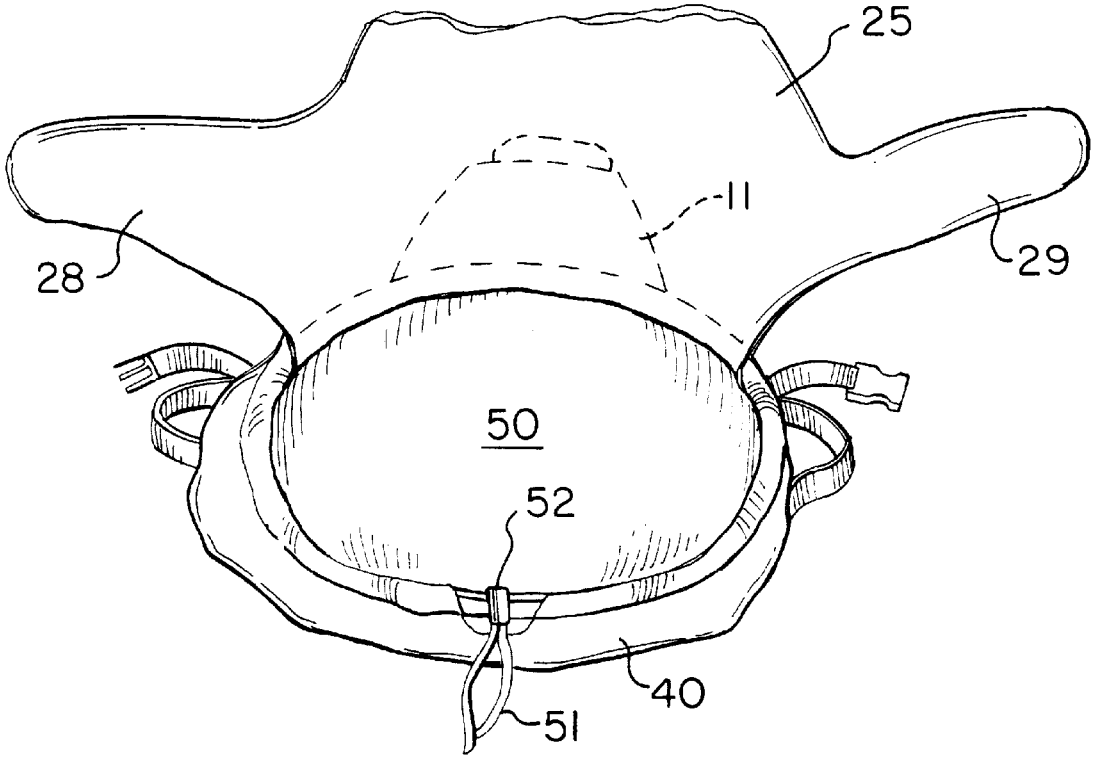
FIG. 7 is a partial bottom view of the combination sleeping bag and backpack of FIG. 1, this figure showing a stuff pouch that is located within and at the bottom of the head of the Himalayan bear character, this stuff pouch enabling a child to stuff the body of the sleeping bag, into the stuff pouch.

FIG. 7 is a partial bottom view of the combination sleeping bag, item of display, and backpack 10 of FIG. 1, this figure showing a stuff pouch 50 that is located within and at the bottom or neck portion of head 11 of the Himalayan bear character. Note that the main body of the sleeping bag portion is shown in broken view as lifted upwardly to expose the opening of pouch 50. The open mouth of stuff pouch 50 is encircled by a draw string 51 within a tubular sleeve and having a conventional barrel slide 52 associated therewith at an opening in that sleeve.

Body portion 12 in this example is attached along the interior of the opening of pouch 50, as shown in FIG. 7, although it could be attached outside of the pouch 50 opening. Thus, when the sleeping bag is not in use, body portion 12 of device 10 can easily be stuffed into stuff pouch 50 by the child, i.e., the body 12 of the sleeping bag may be rolled and folded so that it can be stuffed into stuff pouch 50. After inserting body portion 12 into pouch 50, barrel slide 52 is moved inwardly along draw-string 51 to reduce the size of the mouth of stuff pouch 50 and thereby secure body 12 within stuff pouch 50.

Figure 8:
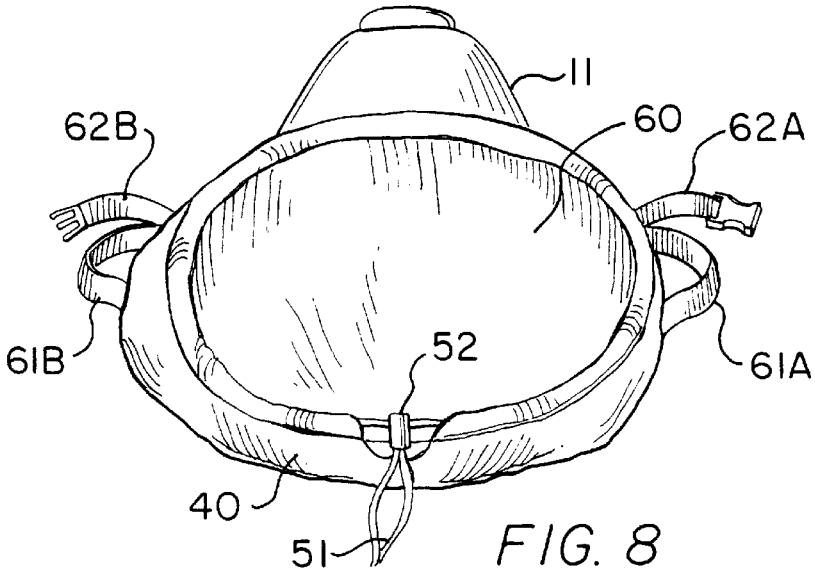
FIG. 8 is a view similar to FIG. 7 wherein the body of the sleeping bag is completely stuffed into the stuff pouch and wherein a barrel-type slide fastener is positioned along draw strings to thereby reduce the size of the stuff pouch opening.

FIG. 8 is a view similar to FIG. 7 wherein body 12 of the sleeping bag is completely stuffed into stuff pouch 50, and wherein barrel-type slide fastener 52 has been moved along draw-string 50 to reduce the size of the mouth of stuff pouch 50. In this operational state of device 10, a flat bottom surface 60 is provided for head 11 either by a surface of body 12 or by a separate insert. This accommodates placement of head 11 of article 10 in an upright state on a flat surface for display and the like (see for example FIG. 9).

Figure 10:
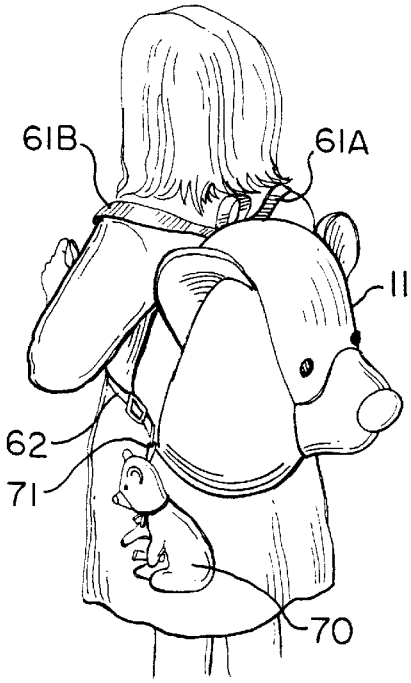

FIG. 9 also shows backpack shoulder straps 61A and 61B and a two-piece chest strap 62 all of which facilitates carrying the stuffed head 11 of the Himalayan bear character on the back of a child, as is shown in FIG. 10.

Figure 11:
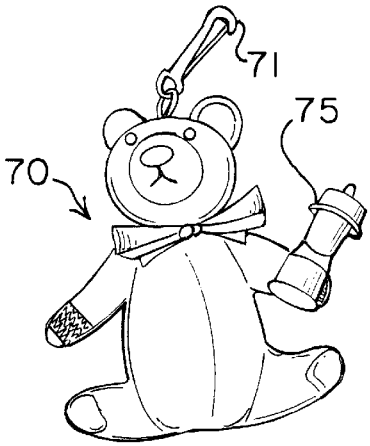
FIG. 11 shows the toy-size sleeping companion or toy character and a small battery operated flashlight, such as a penlight or a squeeze light, that are provided as examples of accessories for the convenience and amusement of the child.

As a feature of the invention, a toy-size sleeping companion or toy character 70 as shown in FIG. 11 is provided for the amusement of the child, and toy character 70 is provided with a conventional spring clip 71 whereby toy character 70 may be releasably attached to article 10. This can be accomplished, for example, by releasable attachment to the shoulder straps 61A, 61B or the chest strap 62 as is shown in FIG. 10.

As a further feature of the invention, a battery-operated flashlight 75, such as a penlight or a squeeze light, is provided for the use and/or amusement of the child, and flashlight 75 is releasable attached to an arm of toy character 70 by the use of Velcro or the like.

From the above detailed description of preferred embodiments of the invention it can be seen that the present invention provides a combined sleeping bag, item of display, and backpack device 10 for use by, and for the entertainment of a human child, wherein device 10 comprises an elongated fabric sleeping bag 12 that is proportioned to contain the extended body of a child, sleeping bag 12 having a front panel 100, a back panel 25, two side portions 101 and 102, a closed bottom portion 103, and an open top portion 13, wherein front panel 100 and bottom panel 25 both having an exterior contour that resembles the front side and the back side of a character that is generally known to children.

This exterior contour of front panel 100 and back panel 25 are shaped to resemble a body portion 12 of the character when the sleeping bag is placed in an elongated and flat state with the back panel 25 engaging a relatively flat surface, as is shown in FIGS. 1–4.

A three-dimensional character head 11 is provided, having a front side 105, a back side 106, and a neck portion 107 that is permanently attached to back panel 25 at the top portion of sleeping bag 12, character head 11 having a face portion on its front side, with the face portion facing in the same direction as front panel 100 of the elongated sleeping bag 12. A manually-operable closure member 88 releasably closes at least a portion of at least one of the two side portions 101, 102.

A stuff pouch 50 is formed internal of character head 11, generally at a location whereat the 107 neck portion of character head 11 is attached to back panel 25. This stuff pouch 50 receives the sleeping bag in a generally stuffed state, whereby the neck portion 50 of the character head forms a relatively flat base 60 that facilitates placement of stuffed character head 11 in an upright attitude on a surface for display, as shown in FIG. 9.

Shoulder straps 61 and back straps 62 are attached to character head 11 for encircling the body of a child to enable stuffed character head 11 to be carried by a child with the face portion of character head 11 facing backward of the child and with the character head in an upright attitude, as shown in FIG. 10.

A pillow pouch 80 is formed on the interior surface of back panel 25 at the location whereat the neck portion 107 of character head 11 is attached to back panel 25, this pillow pouch 80 being openable as shown in FIG. 6 to receive a pillow for supporting the head of a sleeping child.

A toy-sized stuffed character 70 that resembles adult character 11, 12 is shown releasably attached to the adult character, as shown in FIG. 10, and a battery-operated light 75 is likewise shown as an accessory releasably attached to the toy-sized character 70.

The invention has been described in detail while making reference to preferred embodiments thereof. However, since it is known that others skilled in art will, upon learning of the invention, readily visualize yet other embodiments, changes, modifications, additions, and applications of this invention that are within the spirit and scope of the invention, the above detailed description is not to be taken as a limitation on the spirit and scope of the invention.

What is claimed is:

1. A combined sleeping bag, item of display, and backpack for use by, and for the entertainment of, a human child, comprising:

an elongated fabric sleeping bag that is proportioned to contain at least the extended body of a child, said sleeping bag having a front panel, a back panel, two side portions, a closed bottom portion, and an open top portion, said front panel and said bottom panel respectively having an exterior contour that resembles a character that is generally known to children, and said exterior contour being shaped to resemble a body portion of said character when said sleeping bag is placed in an elongated and flat state with said back panel engaging a relatively flat surface;

a character head having a front side, a back side, and a neck portion that is permanently attached to said back panel at said top portion of said sleeping bag, said character head having a face portion on said front side, said face portion facing in the same direction as said front panel of said elongated sleeping bag;

a manually-operable closure member releasably closing at least a portion of at least one of said two side portions;

a stuff pouch formed internal of said character head;

said stuff pouch within said character head for receiving said sleeping bag in a generally stuffed state, whereby said neck portion of said character head is enlarged to form a relatively flat base that facilitates placement of said stuffed character head in an upright attitude on a surface for display of said stuffed character head; and shoulder straps attached to said character head for encircling the body of a child to enable said stuffed character head to be carried by a child with said face portion facing to backward of the child and with said character head in said upright attitude.

2. The combined sleeping bag, item of display, and backpack of claim 1 wherein said stuff pouch includes an open-mouth portion that is located generally whereat said neck portion of said character head is attached to said back panel said top portion of said sleeping bag.

3. The combined sleeping bag, item of display, and backpack of claim 2 wherein said character head is formed in a three-dimensional manner so as to extend upward from said flat state of said elongated sleeping bag.

4. The combined sleeping bag, item of display, and backpack of claim 2, including:

a pillow pouch formed in said back panel of said sleeping bag at said location whereat said neck portion of said character head is attached to said back panel, said pillow pouch for receiving a pillow for supporting the head of a child.

5. The combined sleeping bag, item of display, and backpack of claim 4 wherein said pillow pouch is formed on an interior surface of said back panel of said elongated sleeping.

6. The combined sleeping bag, item of display, and backpack of claim 1 wherein said character head is formed of a fabric that is stitched in a manner to extend upward from said flat state of said elongated sleeping bag, thus forming a three-dimensional character head.

7. The combined sleeping bag, item of display, and backpack of claim 1 wherein said outer contour of said flat state sleeping bag resembles an animal of said given species, including:

a toy-sized stuffed animal; and manually-releasable means attaching said toy-sized animal to said sleeping bag.

8. The combined sleeping bag, item of display, and backpack of claim 7 wherein said toy-sized animal is shaped to resemble said animal of said given species.

9. The combined sleeping bag, item of display, and backpack of claim 7, including:

a battery-operated light releasably attached to said toy-sized animal.

10. A device selectively providing sleeping bag utility, an item of display utility, or backpack transport utility to a human individual, the device comprising:

a cloth sleeping bag having an outer contour resembling the body of a character that is of general interest to the individual;

said sleeping bag having a back contour panel and a front contour panel that are secured together at boarder edges thereof to form a sleeping compartment having an open top for receiving the body of the individual;

a character head attached to said back contour panel adjacent to said open top of said sleeping compartment;

a stuff pouch within said character head, said stuff pouch having an opening for receiving said sleeping bag;

said character head, when in a stuffed condition, providing a relatively flat bottom surface enabling said stuffed character head to be displayed on a shelf or the like; and backpack shoulder straps attached to said character head;

said backpack shoulder straps for use by the individual in transporting said stuffed character head.

11. The device of claim 10 which includes a pillow pouch formed in said back contour panel adjacent to said character head.

12. The device of claim 11 wherein said character head is a three-dimensional character head that extends vertically higher than said pillow pouch.

* * * * *